US008235754B2

(12) United States Patent
Kume

(10) Patent No.: US 8,235,754 B2
(45) Date of Patent: Aug. 7, 2012

(54) TERMINAL BLOCK HAVING PLURALITY OF FIRST AND SECOND TERMINALS FIXED TO A BASE BY SCREWS

(75) Inventor: Tsutomu Kume, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/007,453

(22) Filed: Jan. 14, 2011

(65) Prior Publication Data

US 2011/0177723 A1 Jul. 21, 2011

(30) Foreign Application Priority Data

Jan. 15, 2010 (JP) ..... 2010-006817
Oct. 27, 2010 (JP) ..... 2010-240578

(51) Int. Cl.
*H01R 24/00* (2011.01)

(52) U.S. Cl. ..... 439/637

(58) Field of Classification Search ..... 439/637, 439/632, 626, 709, 188
See application file for complete search history.

(56) References Cited

U.S. PATENT DOCUMENTS 4,514,030 A * 4/1985 Triner et al. ..... 439/188
5,163,847 A * 11/1992 Regnier ..... 439/157
5,509,826 A * 4/1996 White ..... 439/637
5,913,699 A * 6/1999 Zielke ..... 439/632
6,638,111 B1 * 10/2003 McDaid et al. ..... 439/607.09
6,666,702 B1 * 12/2003 Pickles ..... 439/328
7,048,567 B2 * 5/2006 Regnier et al. ..... 439/329
7,585,188 B2 * 9/2009 Regnier ..... 439/637
7,959,447 B2 * 6/2011 Lim ..... 439/79
2007/0010125 A1 * 1/2007 Regnier ..... 439/495
2010/0248549 A1 * 9/2010 Lim ..... 439/626

FOREIGN PATENT DOCUMENTS

JP 2002-203616 7/2002

OTHER PUBLICATIONS

Patent Abstracts of Japan for patent application with Publication No. 2002-203616, Publication Date: Jul. 19, 2002, 1 page.
Mechanical English translation for patent application with Publication No. 2002-203616, Publication Date: Jul. 19, 2002, 12 pages.

* cited by examiner

*Primary Examiner* — Chandrika Prasad
(74) *Attorney, Agent, or Firm* — Osha Liang LLP

(57) ABSTRACT

A terminal block, configured to be connected to a plurality of first card edge terminals arranged at a peripheral edge part of a first main surface of a substrate and a plurality of second card edge terminals arranged at a peripheral edge of one of a second main surface of the substrate and the first main surface of the substrate, has a base formed with an insertion port to which the peripheral edge of the substrate is inserted, and a plurality of first and second terminals arranged on the base. Each of the plurality of first terminals has a first supporting portion arranged on the first main surface side of the substrate and extended in a normal direction of the first and second main surfaces of the substrate inserted to the insertion port, and a first contacting portion formed from the first supporting portion to contact the first card edge terminals.

17 Claims, 18 Drawing Sheets

TERMINAL BLOCK HAVING PLURALITY OF FIRST AND SECOND TERMINALS FIXED TO A BASE BY SCREWS

BACKGROUND OF THE INVENTION

1. Technical Field

The present invention relates to terminal blocks, and in particular, to a card edge type terminal block.

2. Related Art

For instance, a terminal block including an attachable/detachable mechanism in view of maintenance and the like is increasing as a terminal block used in a unit configuring an electronic device such as a remote I/O terminal and a programmable controller, and the like. Such terminal block includes (1) a terminal block of two-piece type, and (2) a terminal block of card edge type.

FIG. 17 is a view showing a configuration example of the terminal block of two-piece type of the prior art. With reference to FIG. 17, a terminal block 500 of two-piece type includes a terminal block main body 501 and a base 502. The terminal block main body 501 is attached to a case of an electronic device (not shown), for example, and the base 502 is mounted on a circuit substrate accommodated in the case of the electronic device.

The base 502 on the circuit substrate side includes pins 505 and 506, and the terminal block main body 501 includes terminals 503 and 504. The terminal block and the substrate are electrically connected by inserting the pins 505 and 506 on the base 502 side to the terminals 503 and 504. The terminals 503 and 504 contact an electric wire (not shown) by a screw 507 and a nut 508. The terminal block of two-piece type is disclosed in Japanese Unexamined Utility Model Publication No. 1-111486 and the like.

FIG. 18 is a view showing a configuration example of the terminal block of card edge type of the prior art. With reference to FIG. 18, a terminal block 600 includes a case 601, and terminals 603 and 604 accommodated in the case. The terminal block 600 is attached to the case of the electronic device, and the like. A plurality of electrodes (card edge terminals) is arranged along the peripheral edge direction of the circuit substrate on both surfaces or one surface of an end of the circuit substrate 620 accommodated in the case of the electronic device. The terminal block 600 and the circuit substrate 620 are electrically connected by inserting the electrodes on the circuit substrate 620 side to the terminals 603 and 604 of the terminal block 600. A screw 607 and a nut 608 configure a connecting portion for connecting the terminal and an electric wire. The connecting portion is positioned in the direction of an extended line, which extends from an insertion port of the substrate in an inserting direction of the substrate.

The terminal block of card edge type is disclosed in Japanese Unexamined Utility Patent Publication No. 2002-203616, and the like. According to Japanese Unexamined Utility Patent Publication No. 2002-203616, a slidable slider is arranged on the back surface of a terminal block connector main body. The fixing (lock) and the releasing of the lock between the case of the electronic device and the terminal block connector main body are realized by the slider movement of the slider.

SUMMARY

In the terminal block of two-piece type, the base needs to be mounted on the circuit substrate in the terminal block of two-piece type. Therefore, the number of configuring components such as a contact increases.

In the terminal block of two-piece type, a method for fixing the terminal block main body is necessary. Two methods, a screwing method and an angle hook method, are mainly adopted for the terminal block of two-piece type. The screwing method is a method for fixing both ends of the terminal block in the longitudinal direction with screws. The angle hook method is a method for fixing the terminal block main body with an angle hook with nail arranged at both ends of the terminal block in the longitudinal direction.

Such fixing method is also a factor of increase in cost. In the case of the screwing method, an insert metal needs to be inserted to the case of the electronic device to form a female screw while molding or after molding the case of the electronic device. In the case of the angle hook method, on the other hand, the number of components such as the angle hooks increases and the number of assembly steps increases.

The terminal block of card edge type is advantageous than the terminal block of two-piece type in terms of cost since the base does not need to be mounted on the substrate. However, the terminal block and the circuit substrate as a whole become long towards terminal block if the terminal block of card edge type of the prior art is connected to the circuit substrate.

Therefore, in the case of the terminal block of card edge type of the prior art, consideration is made in having the insertion depth of the terminal block long so that the end of the circuit substrate is inserted to the terminal block as deep as possible when miniaturizing the terminal block and the circuit substrate entirely. In the case of such configuration, however, the area of the portion occupied by the terminal bock at the surface of the substrate increases. Furthermore, the portion occupied by the terminal block exists on both surfaces of the substrate. The mounting area of the surface of the circuit substrate thus narrows. This is a great restriction when miniaturizing the unit.

One or more embodiments of the present invention provides a terminal block capable of reducing the occupying area at the surface of the circuit substrate while suppressing increase in cost.

In accordance with one aspect of the present invention, there is provided a terminal block connected to a plurality of first card edge terminals arranged at a peripheral edge part of a first main surface of a substrate as well as a plurality of second card edge terminals arranged at a peripheral edge of one of a second main surface of the substrate and the first main surface of the substrate. The terminal block includes a base formed with an insertion port to which the peripheral edge of the substrate is inserted; and a plurality of first and second terminals arranged on the base. Each of the plurality of first terminals includes a first supporting portion and a first contacting portion. The first supporting portion is arranged on the first main surface side of the substrate and extended in a normal direction of the first and the second main surfaces of the substrate inserted to the insertion port. The first contacting portion is formed to contact the first card edge terminals from the first supporting portion. Each of the plurality of second terminals includes a second supporting portion and a second contacting portion. The second supporting portion is arranged on the first main surface side of the substrate and extended in a normal direction of the first and second main surfaces of the substrate. The first contacting portion is formed to contact the second card edge terminals from the second supporting portion.

The plurality of second terminals according to one or more embodiments of the present invention is arranged on the front side than the plurality of first terminals along an inserting direction of the substrate.

The plurality of second card edge terminals according to one or more embodiments of the present invention is arranged on the second main surface of the substrate. A distal end of the second portion is positioned on the second main surface side of the substrate. The second contacting portion is formed to incline in a direction opposite to the inserting direction of the substrate with respect to the normal direction of the substrate from the distal end of the second supporting portion, and contact the second card edge terminals.

The first contacting portion according to one or more embodiments of the present invention is extended to incline in the inserting direction of the substrate from the normal direction of the first and second main surfaces, and includes a first distal end. The first distal end contacts the first card edge terminals when the first contacting portion is folded back diagonally to the upper side with respect to the first main surface of the substrate assuming the normal direction of the substrate is an up and down direction. The second contacting portion includes a second distal end. The second distal end contacts the second card edge terminals by being folded back from the second contacting portion diagonally to the lower side with respect to the second main surface of the substrate assuming the normal direction of the substrate is an up and down direction. The first distal end and the second distal end are arranged so that positions in the inserting direction are different from each other.

The first contacting portion according to one or more embodiments of the present invention is extended so as to incline in the direction opposite to the inserting direction of the substrate from the normal direction of the first and the second main surfaces.

The plurality of second card edge terminals according to one or more embodiments of the present invention is arranged on the first main surface of the substrate. The distal end of the second supporting portion is positioned on the first main surface side of the substrate. The second contacting portion is formed to incline in the inserting direction of the substrate with respect to the normal direction of the substrate from the distal end of the second supporting portion, and contact the second card edge terminals.

The plurality of second card edge terminals according to one or more embodiments of the present invention is arranged on the first main surface of the substrate. The distal end of the second supporting portion is positioned on the first main surface side of the substrate. The second contacting portion is formed to incline in the direction opposite to the inserting direction of the substrate with respect to the normal direction of the substrate from the distal end of the second supporting portion, and contact the second card edge terminals.

The first contacting portion according to one or more embodiments of the present invention is more extended to incline in the inserting direction of the substrate from the normal direction of the first and second main surfaces.

The first contacting portion according to one or more embodiments of the present invention is more extended to incline in the direction opposite to the inserting direction of the substrate from the normal direction of the first and second main surfaces.

The terminal block according to one or more embodiments of the present invention further includes a plurality of screw-type connecting portions for electrically connecting each of the plurality of first terminals and the plurality of second terminals to a corresponding electric wire.

The terminal block according to one or more embodiments of the present invention further includes a plurality of clamp-type connecting portions for electrically connecting each of the plurality of first terminals and the plurality of second terminals to a corresponding electric wire.

The terminal block according to one or more embodiments of the present invention further includes a plurality of insulation displacement type connecting portions for electrically connecting each of the plurality of first terminals and the plurality of second terminals to a corresponding electric wire.

According to one or more embodiments of the present invention, a terminal block capable of reducing the occupying area at the surface of the circuit substrate while suppressing increase in cost is realized.

DETAILED DESCRIPTION

Figure 1:
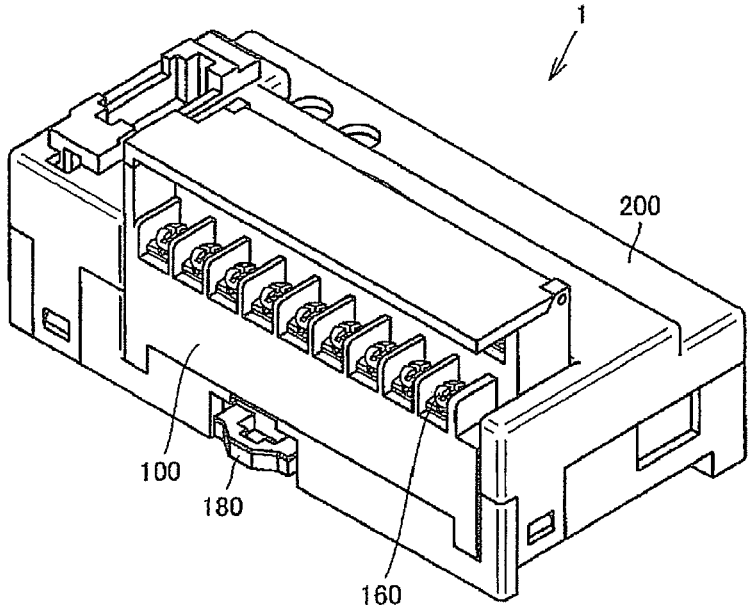
FIG. 1 is a perspective view of an outer appearance of an electronic device including a terminal block according to a first embodiment of the present invention.

Hereinafter, embodiments of the present invention will be described with reference to the drawings. The same reference numerals are denoted for the same or corresponding portions in the figures, and the description thereof will not be repeated. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

[First Embodiment]

Figure 2:
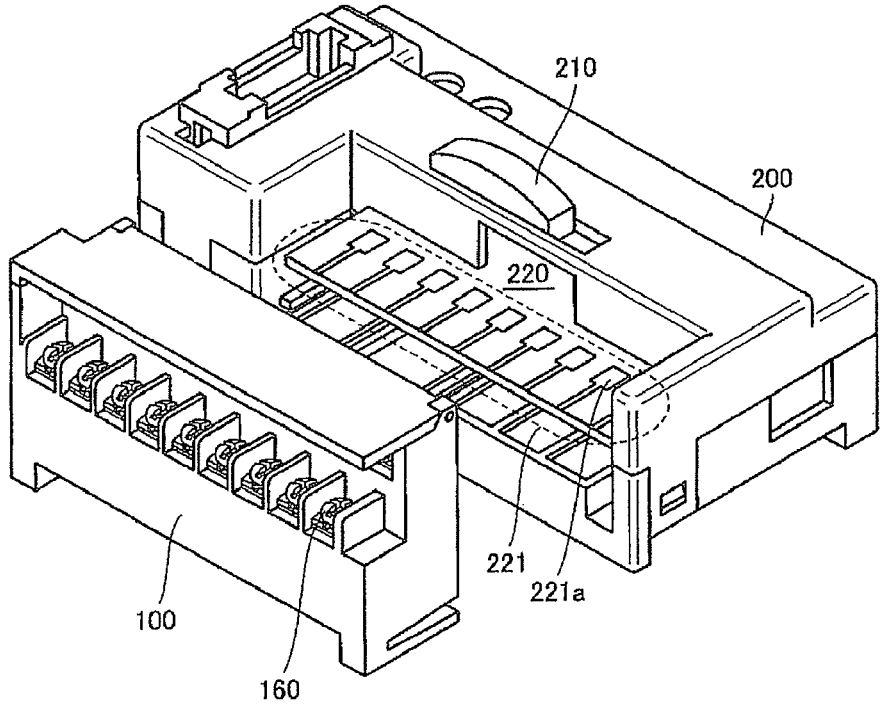
FIG. 2 is a view describing a state in which the terminal block according to the first embodiment of the present invention is detached from the electronic device.
Figure 3:
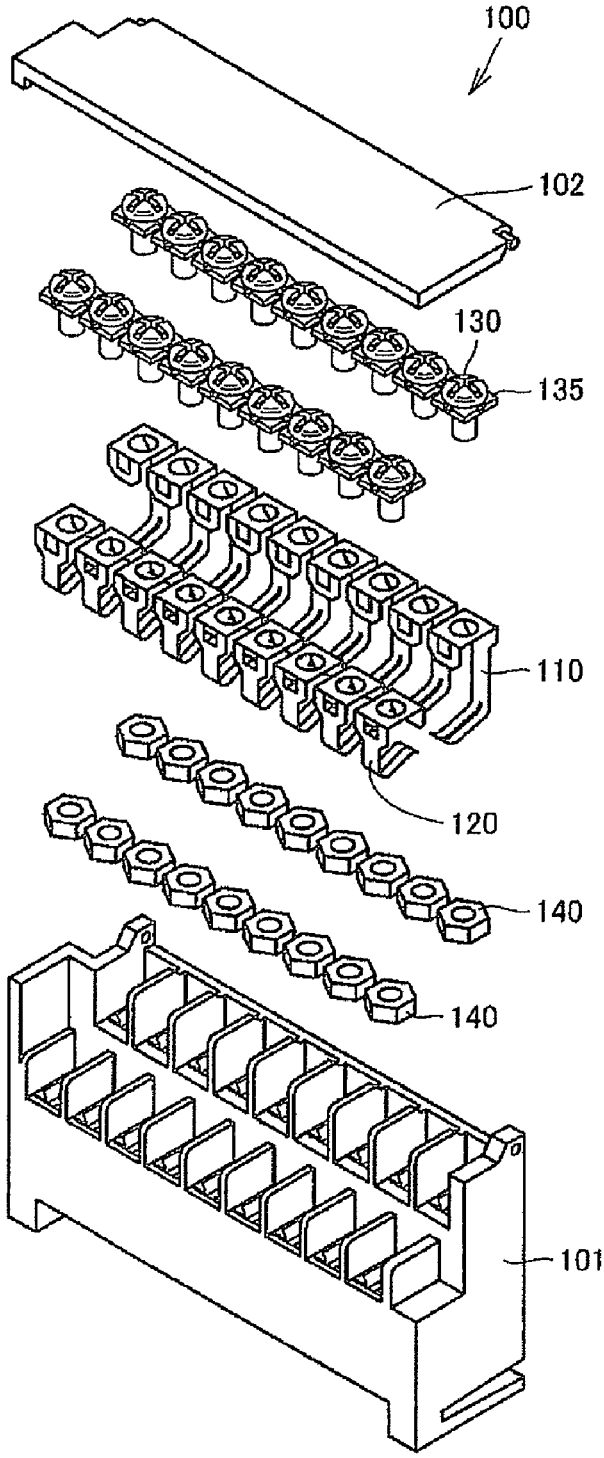
FIG. 3 is an exploded perspective view of the terminal block shown in FIGS. 1 and 2.

FIG. 1 is a perspective view of an outer appearance of an electronic device including a terminal block according to a first embodiment of the present invention. FIG. 2 is a view describing a state in which the terminal block according to the first embodiment of the present invention is detached from the electronic device. FIG. 3 is an exploded perspective view of the terminal block shown in FIGS. 1 and 2.

With reference to FIGS. 1 to 13, an electronic device 1 according to the first embodiment of the present invention is a remote I/O terminal for configuring an industrial controller and other FA networks. The electronic device 1 includes a terminal block 100 and a device main body 200. The terminal block 100 is configured to be attachable/detachable with respect to the device main body 200. The device main body 200 includes a slidable slider 210 to enable the terminal block 100 to fix (lock) to and release the lock with the device main body 200. A slider 180 for attaching and detaching the electronic device 1 to a DIN rail and the like is also arranged in the device main body 200.

The terminal block 10 is configured to be connectable with a circuit substrate 220 arranged in the device main body 200. A plurality of electrodes 221*a* is arranged along a peripheral edge direction (side direction) of the circuit substrate 200 on both surfaces of ends 221 of the circuit substrate 220. In other words, the plurality of electrodes 221*a* is so-called card edge terminals, and the terminal block 100 is a terminal block of card edge type. A connecting portion 160 is also arranged in the terminal block 100 for every terminal to connect each terminal of the terminal block 100 to various wiring (electric wire).

As shown in FIG. 3, the terminal block 100 includes a base 101, a lid 102 attached to the base 101 in an openable/closable manner, a plurality of terminals 110 and 120 attached to the base 101, a plurality of screws 130 and a plurality of washers 135 corresponding to the plurality of terminals 110 and 120, and a plurality of nuts 140 respectively tightened with the screw 130 through the washer 135.

Each of the plurality of terminals 110 and 120 is formed by a member that can be elastically deformed and that has conductivity such as a phosphor bronze thin plate. In the present embodiment, the number of terminals 110 and terminals 120 is nine, but the number of terminals is not limited thereto.

The plurality of terminals 110 and 120 is arranged divided into two upper and lower stages at the upper part of the base 101. The plurality of terminals 110 is arranged at the upper stage and are lined along the arrangement direction of the electrodes 221*a* so as to contact the electrodes 221*a* arranged on one surface (surface shown in FIG. 2) of the end 221 of the circuit substrate 220. The plurality of terminals 120 is arranged at the lower stage. The plurality of terminals 120 is arranged on the front side of the plurality of terminals 110 in the inserting direction to the terminal block of the circuit substrate 220. The plurality of terminals 120 is lined along the arrangement direction of the electrodes 221*a* so as to contact the electrodes 221*a* arranged on the other surface of the end 221 of the circuit substrate 220.

In the following, the configuration of the terminal block will be described based on a state in which the circuit substrate 220 is installed in the horizontal direction (see FIG. 2). Therefore, the direction perpendicular to the surface of the circuit substrate 200 will be defined as "up and down direction" in the following description.

Figure 4:
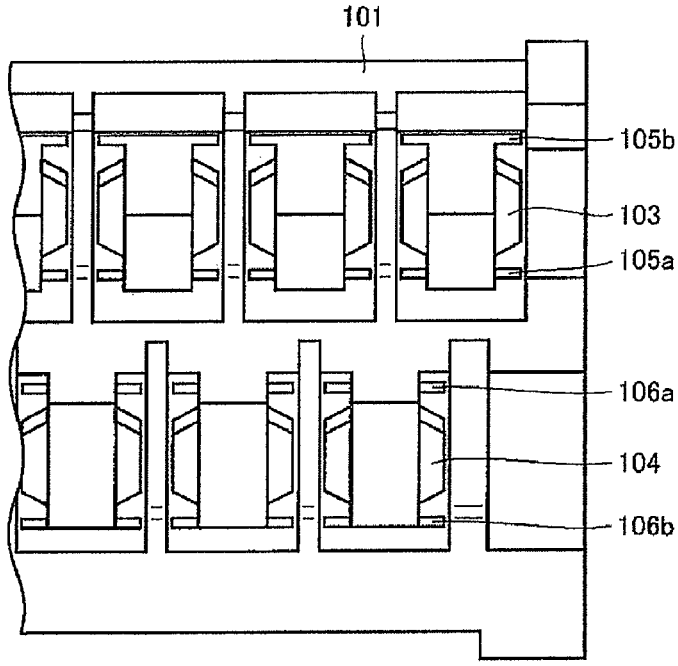
FIG. 4 is a partially enlarged view of the surface at the upper part of the base of the terminal block.

FIG. 4 is a partially enlarged view of the surface at the upper part of the base of the terminal block. With reference to FIG. 4, nut receiving portions 103, 104 or recesses for receiving the nut 140 are formed at the surface at the upper part of the base 101. The nut receiving portion 103 is a recess for receiving the nut 140 to be tightened with the screw 130 for fixing the terminal 110. The nut receiving portion 104 is a recess for receiving the nut 140 to be tightened with the screw 130 for fixing the terminal 120.

The base 101 is formed with a groove 105*a* and a through-hole 105*b* that communicates to a space inside from the surface at the upper part of the base 101 adjacent to the nut receiving portion 103. The base 101 is also formed with a groove 106*a* and a through-hole 106*b* that communicates to a space inside from the surface of the base 101 adjacent to the nut receiving portion 104.

Figure 5:
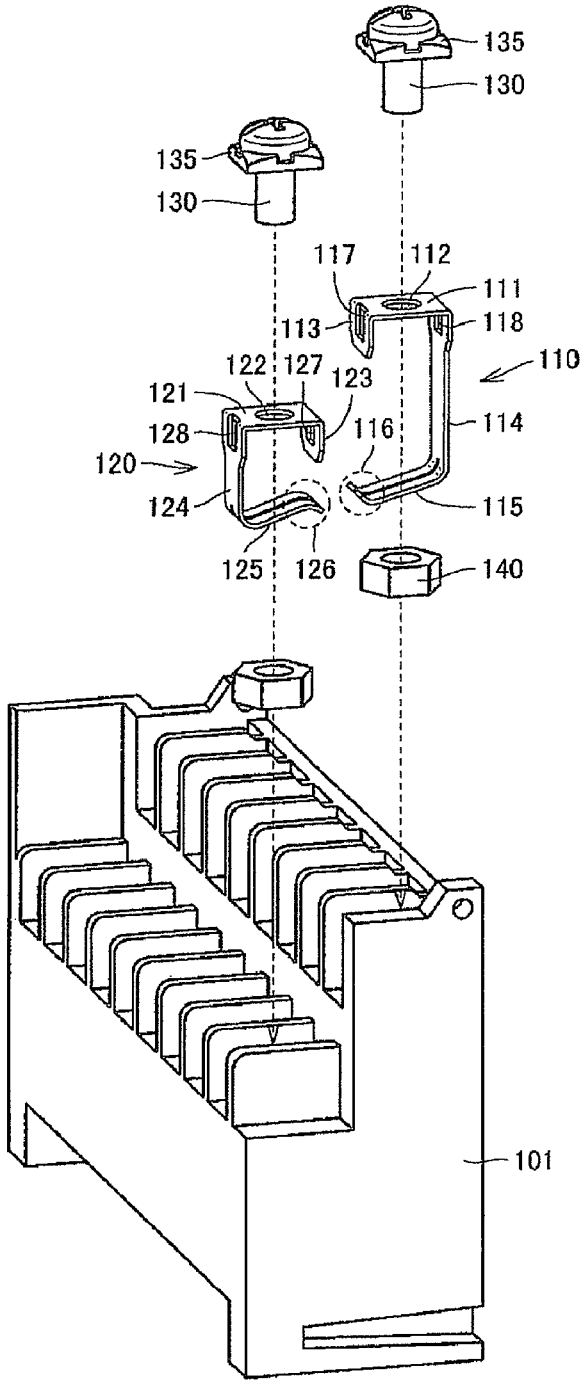
FIG. 5 is a view describing the configuration of the terminal and the attachment of the terminal to the base.
Figure 6:
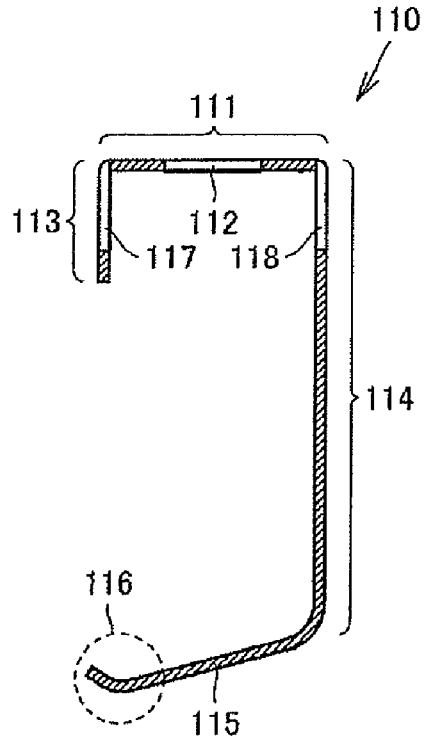
FIG. 6 is a cross-sectional view of the terminal 110.

FIG. 5 is a view describing the configuration of the terminal and the attachment of the terminal to the base. FIG. 6 is a cross-sectional view of the terminal 110, and FIG. 7 is a cross-sectional view of the terminal 120.

Figure 7:
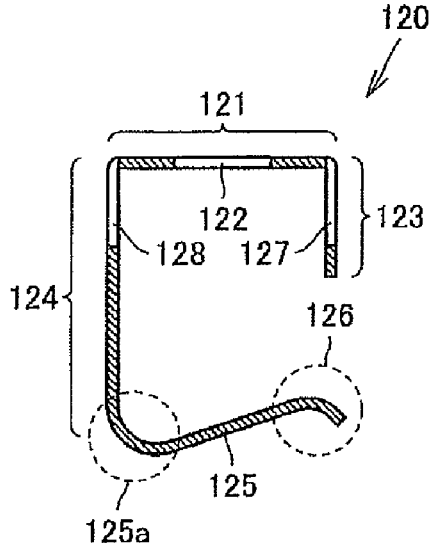
FIG. 7 is a cross-sectional view of the terminal 120.

With reference to FIGS. 5 to 7, the terminal 110 is formed with a through-hole 112 for passing the screw 130, and includes a connecting portion 111 to be electrically connected with an electric wire (not shown), a bending portion 113 bend to the lower side of the connecting portion 111 at substantially right angle from one end of the connecting portion 111, a supporting portion 114 bent to the lower side of the connecting portion 111 at substantially right angle from the end of the connecting portion 111 positioned on the opposite side of the bent portion 113, and a contacting portion 115 for contacting with the electrode 221*a* of the circuit substrate 220. The contacting portion 115 is formed from the distal end of the supporting portion 114 so as to bend diagonally downward, and is inclined in the substrate inserting direction. A distal end 116 of the contacting portion 115 is folded back diagonally upward towards the bent portion 113 side.

The bent portion 113 is formed with a through-hole 117. A through-hole 118 is also formed at the portion from the end of the connecting portion 111 to the vicinity of the end of the connecting portion in the supporting portion 114.

The terminal 120 is formed with a through-hole 122 for passing the screw 130, and includes a connecting portion 121 to be electrically connected with an electric wire (not shown), a bending portion 123 bend to the lower side of the connecting portion 121 at substantially right angle from one end of the connecting portion 121, a supporting portion 124 bent to the lower side of the connecting portion 121 at substantially right angle from the end of the connecting portion 121 positioned on the opposite side of the bent portion 123, and a contacting portion 125 for contacting with the electrode 221*a* of the circuit substrate 220. The contacting portion 115 includes a curved part 125*a* that is folded back so as to be curved diagonally upward from the distal end of the supporting portion 124, and thus is formed to extend diagonally upward by such curved portion 125*a*. Therefore, the contacting portion 125 is inclined to the direction opposite to the substrate inserting direction. A distal end 126 of the contacting portion 125 is folded back diagonally downward so as to move away from the bent portion 123.

The bent portion 123 is formed with a through-hole 127. A through-hole 128 is also formed at the portion from the end of the connecting portion 121 to the vicinity of the end of the connecting portion in the supporting portion 124.

The assembly of the terminals 110 and 120 to the base 101 will now be described with reference to FIGS. 4 and 5. First, the nuts 140 are inserted to the nut receiving portion 103 and the nut receiving portion 104. The terminal 110 is then inserted to the through-hole 105*b* in the order of the contacting portion 115 and the supporting portion 114 from the distal end 116 of the contacting portion 115, and then the bent portion 113 is inserted to the groove 105*a*. The connecting portion 111 of the terminal 110 is thereby mounted on the nut 140 inserted to the nut receiving portion 103.

Similarly, the terminal 120 is inserted to the through-hole 106*b* in the order of the contacting portion 125 and the supporting portion 124 from the distal end 126 of the contacting portion 125, and then the bent portion 123 is inserted to the groove 102*a*. The connecting portion 121 of the terminal 120 is thereby mounted on the surface of the nut 140 inserted to the nut receiving portion 104.

The screw 130 passed through the washer 135 is then passed through the through-hole 112 of the connecting portion 111 in such state, and then the screw 130 and the nut 140 are tightened. Similarly, the screw 130 passed through the washer 135 is passed through the through-hole 122 of the connecting portion 121, and then the screw 130 and the nut 140 are tightened.

The connection between the electrodes of the circuit substrate and the terminals of the terminal block will now be described with reference to FIGS. 8 to 10.

Figure 8:
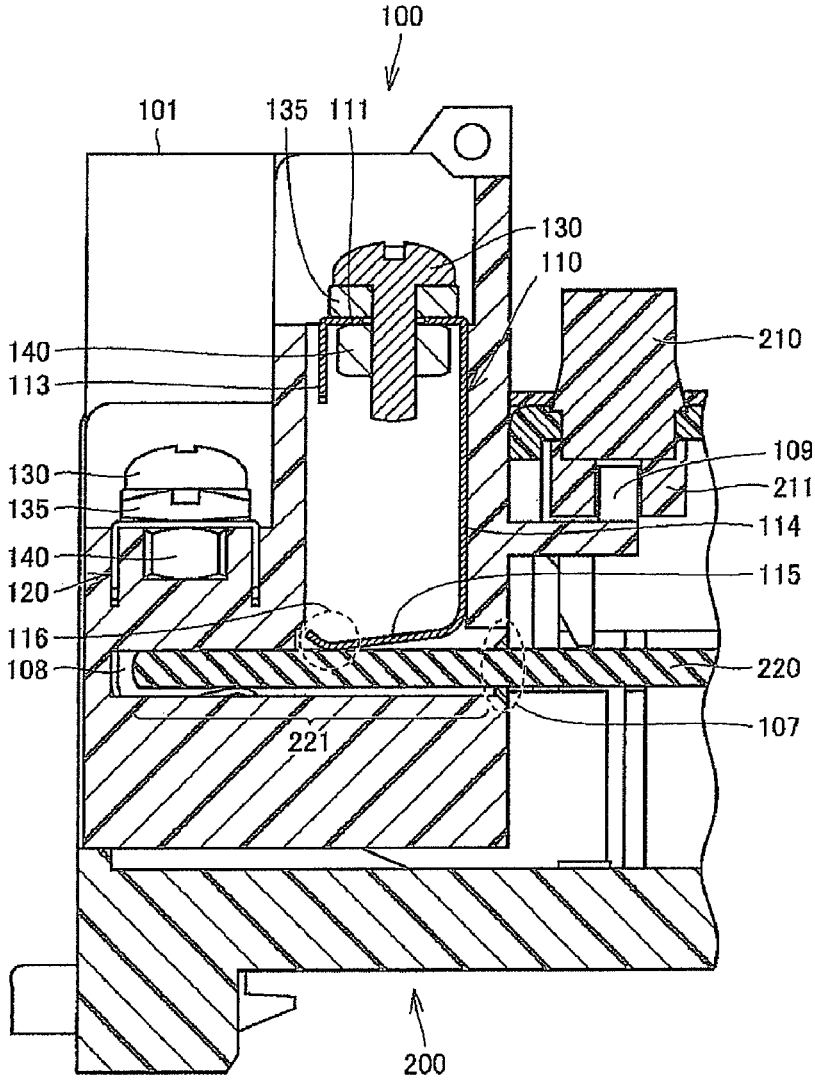
FIG. 8 is a cross-sectional view of the terminal block for describing the terminal 110 of the terminal block and the electrode on the circuit substrate.

FIG. 8 is a cross-sectional view of the terminal block for describing the terminal 110 of the terminal block and the electrode on the circuit substrate. FIG. 9 is a cross-sectional view of the terminal block for describing the terminal 120 of the terminal block and the electrode on the circuit substrate.

Figure 9:
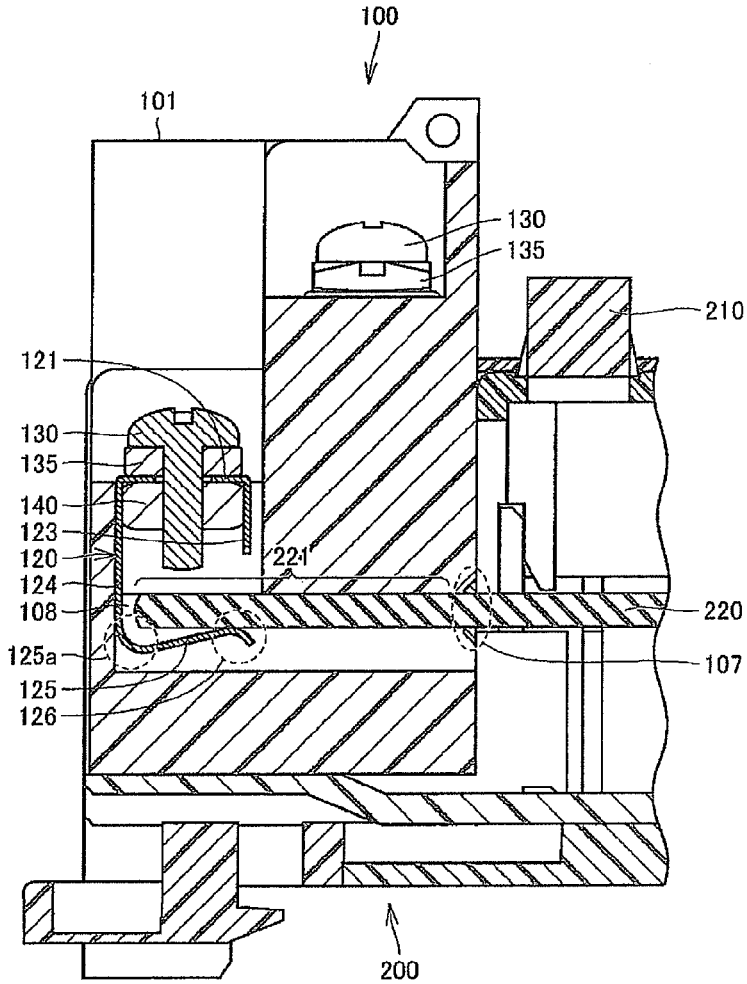
FIG. 9 is a cross-sectional view of the terminal block for describing the terminal 120 of the terminal block and the electrode on the circuit substrate.

With reference to FIGS. 8 and 9, the base 101 of the terminal block 100 is formed with an insertion port 107, to which the circuit substrate 220 is inserted, and a guide groove 108 for guiding the circuit substrate 220 inserted to the insertion port 107 to the inside of the base 101. The base 101 also includes a hook portion 109 to be hooked to the hooking portion 211 of the slider 210. When attaching the terminal block 100 to the device main body 200, the circuit substrate 220 is inserted to the insertion port 107 of the front surface (rear surface) of the base 101, and the base 101 is slidably moved to the position where the hook portion 109 of the base 101 is hooked to the hooking portion 211 of the slider 210. The terminal 221 of the circuit substrate 220 thus slidably moves through the guide groove 108 to be inserted to the inside of the base 101, whereby the terminals 110 and 120 contact the electrodes of the circuit substrate 220.

Figure 10:
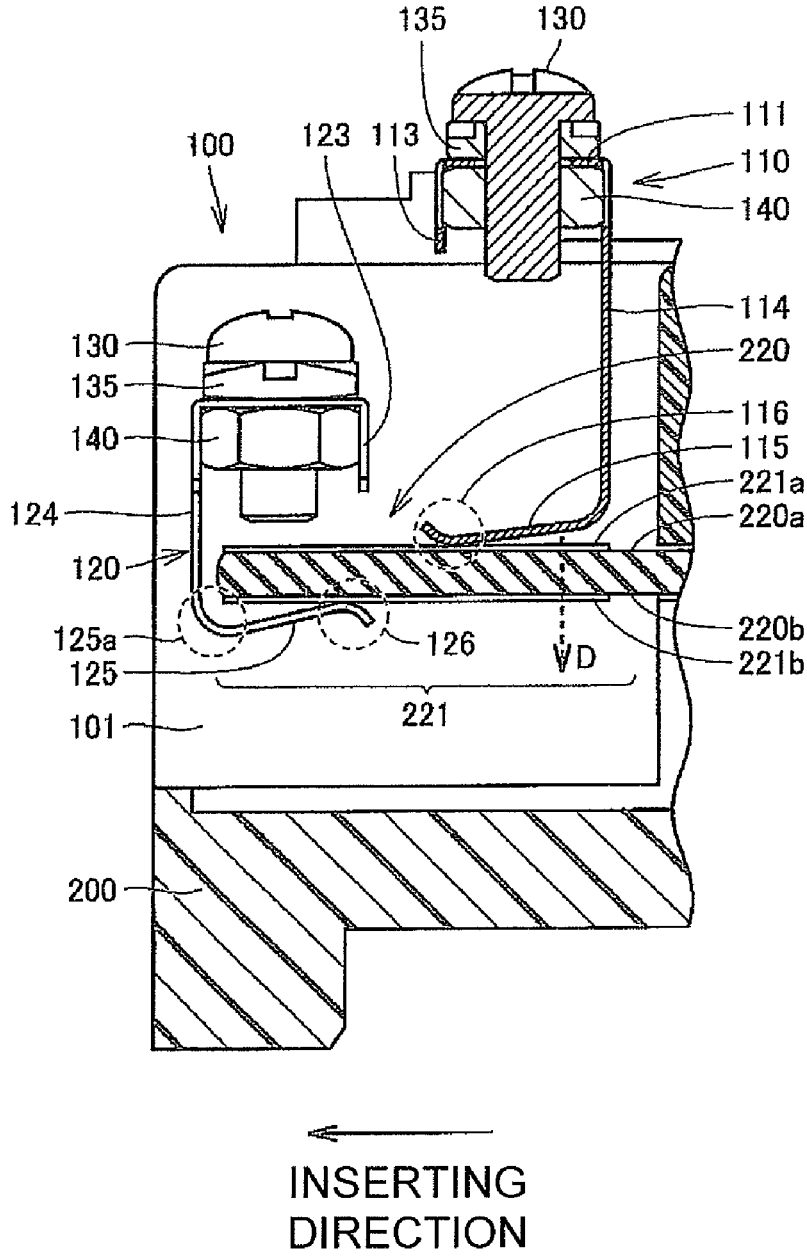
FIG. 10 is a view for describing a state in which the terminals are contacting both surfaces of the circuit substrate.

As shown in FIG. 10, the supporting portion 114 of the terminal 110 is arranged on a main surface 220*a* (first surface) side of the circuit substrate 220, and is extended in a normal direction (direction of arrow D) of the first surface (main surface 220*a*) and a second surface (main surface 220*b*) of the circuit substrate 220 inserted to the insertion port. The contacting portion 115 extends so as to incline in the inserting direction of the circuit substrate 220 with respect to the normal direction of the main surfaces 220*a* and 220*b* of the circuit substrate 220 from the supporting portion 114. The contacting portion 115 is formed to contact the card edge terminal (electrode 221*a*) arranged on the main surface 220*a* of the circuit substrate 220.

The supporting portion 124 of the terminal 120 is arranged on the main surface 220*a* side of the circuit substrate 220 and is extended in the normal direction of the main surfaces 220*a* and 220*b* of the circuit substrate 220. The distal end of the supporting portion 124 (portion to be connected to the curved portion 125*a*) is positioned on the main surface 220*b* side of the circuit substrate 220.

The contacting portion 125 is inclined in the direction opposite to the inserting direction of the circuit substrate 220 with respect to the normal direction. The contacting portion 125 contacts the card edge terminal (electrode 221*b*) arranged on the main surface 220*b* of the circuit substrate 220. The positions of the distal end 116 of the contacting portion 115 and the distal end 126 of the contacting portion 125 in the inserting direction of the circuit substrate 220 are shifted from each other. In other words, when the circuit substrate 220 is seen in plan view from the direction perpendicular to the main surface 220*a* or 220*b* of the circuit substrate 220, the distal end 116 of the contacting portion 115 and the distal end 126 of the contacting portion 125 are at positions not overlapping each other.

Figure 11A:
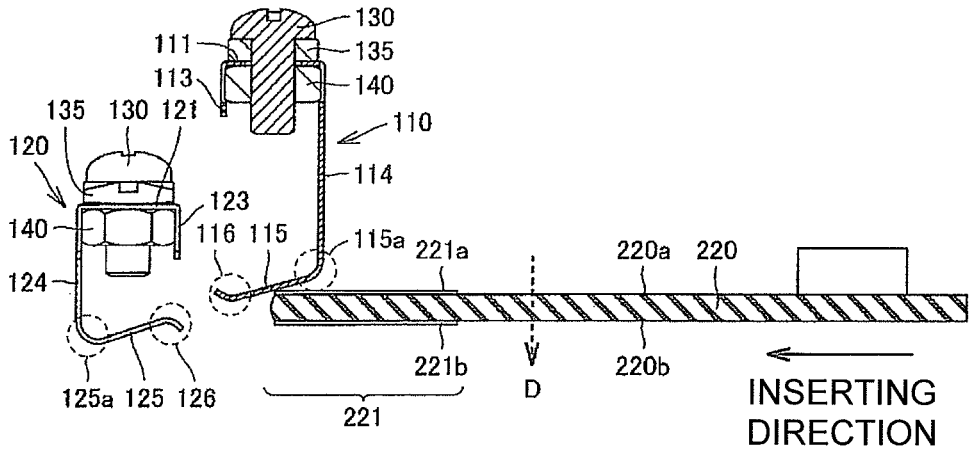
FIGS. 11A to 11C are views for describing the contact of the terminals of the terminal block and the electrodes of the circuit substrate by the deformation of the terminals of the terminal block.
Figure 11B:
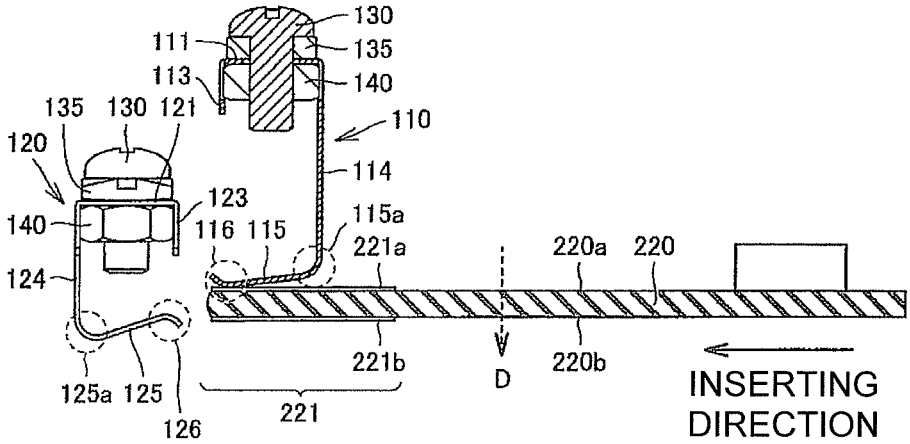
Figure 11C:
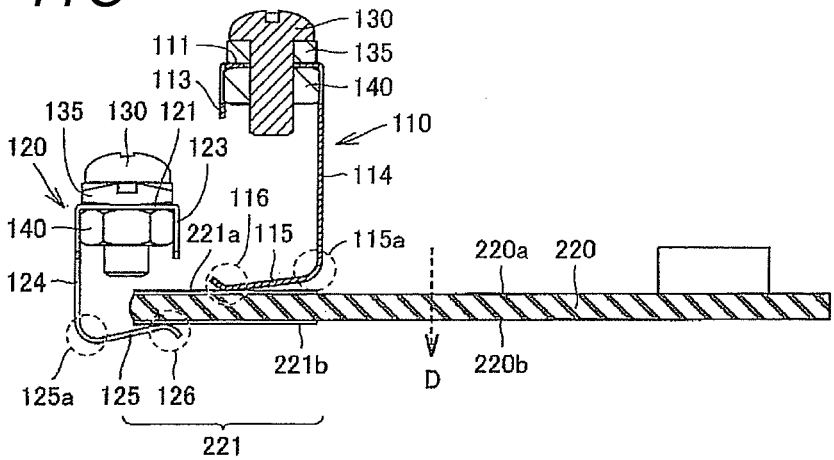

FIGS. 11A to 11C are views for describing the contact of the terminals of the terminal block and the electrodes of the circuit substrate by the deformation of the terminals of the terminal block. FIG. 11A shows a state in which the terminal 221 of the circuit substrate 220 is contacting the terminal 110 when the terminal block 100 is attached to the device main body 200. When the terminal block 100 is moved towards the device main body 200 from such state, the circuit substrate 220 relatively moves with respect to the terminal block 100. Therefore, FIGS. 11A to 11C show the circuit substrate 220 relatively moving with respect to the terminal block (terminals 110 and 120), where the direction of the relative movement of the circuit substrate 220 is indicated as "inserting direction".

When the circuit substrate 220 is moved in the inserting direction, the contacting portion 115 is pushed by the end 221 of the circuit substrate 220. The curved portion 115*a* of the terminal 110 is thus bent lifting up the contacting portion 115.

FIG. 11B shows a state in which the electrode on the first surface side of the circuit substrate 220 is contacting the terminal 110. As described above, the contacting portion 115 is lifted up by the end 221 of the circuit substrate 220. The distal end 116 of the contacting portion 115 contacts the electrode 221*a* of the circuit substrate 220 by the elastic force of the curved portion 115*a*. The distal end 116 is formed to curve towards the first surface (main surface 220*a*) side of the circuit substrate 220. Thus, the circuit substrate 220 can be smoothly moved with the distal end 116 of the contacting portion 115 contacting the electrode 221*a*.

FIG. 11C shows a state in which the electrode on the second surface side of the circuit substrate 220 is contacting the terminal 120. The end 221 of the circuit substrate 220 contacts the distal end 126 of the contacting portion 125 of the terminal 120. The distal end 126 is formed to curve towards the side of the main surface 220*b* of the circuit substrate 220. Therefore, the circuit substrate 220 can be smoothly moved. The contacting portion 125 is pushed down by moving the circuit substrate 220 in the inserting direction. The curved portion 125*a* of the contacting portion 125 then elastically deforms. The distal end 126 of the contacting portion 125 is maintained in a state contacting the electrode 221*b* on the main surface 220*b* side of the circuit substrate 220 by the elastic force of the curved portion 125*a*.

When detaching the terminal block 100 from the device main body 200, the circuit substrate 220 is relatively moved in the direction opposite to the inserting direction shown in FIGS. 11A to 11C. The state of the terminals of the terminal block and the electrodes of the circuit substrate changes in the order of state of FIG. 11C, state of FIG. 11B, and state of FIG. 11A. In this case as well, the circuit substrate can be smoothly moved.

The terminal block 100 according to the present embodiment is a so-called the terminal block of card edge type. Therefore, the electrodes on the circuit substrate and the terminals of the terminal block can be connected without mounting the base to the circuit substrate. The cost is thereby reduced.

Furthermore, according to the present embodiment, the terminals 110, 120 of the terminal block have the configurations shown in FIGS. 6 and 7. The structure of sandwiching the circuit substrate is thereby realized, and hence the electrodes of the circuit substrate and the terminals of the terminal block can be reliably contacted.

Moreover, the positions of the distal end 116 of the contacting portion 115 and the distal end 126 of the contacting portion 125 in the inserting direction of the circuit substrate 220 are shifted from each other. Thus, the circuit substrate can be smoothly moved when contacting the terminals of the terminal block to the electrodes of the circuit substrate, or separating them from the electrodes of the circuit substrate.

Figure 12:
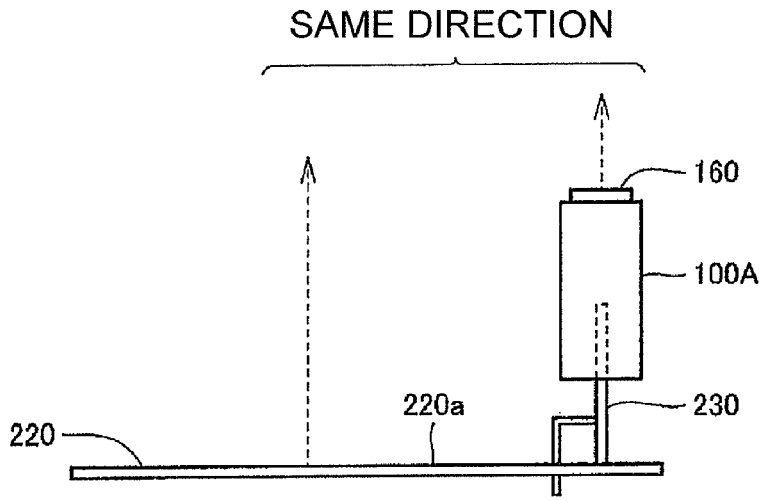
FIG. 12 is a view showing the configuration for directing the connecting portion of the terminal block of card edge type of the prior art in the normal direction of the main surface of the circuit substrate.
Figure 17:
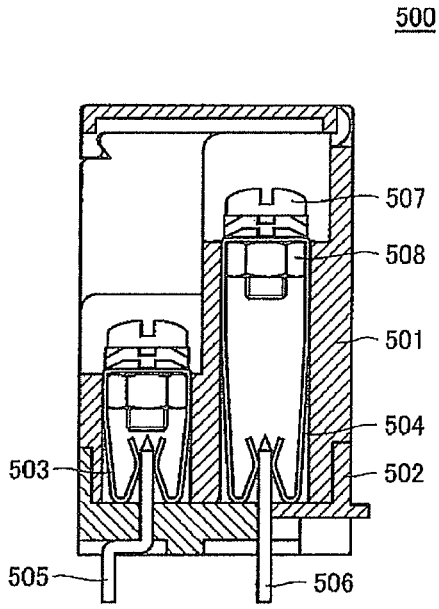
FIG. 17 is a view showing a configuration example of a terminal block of two-piece type of the prior art.
Figure 18:
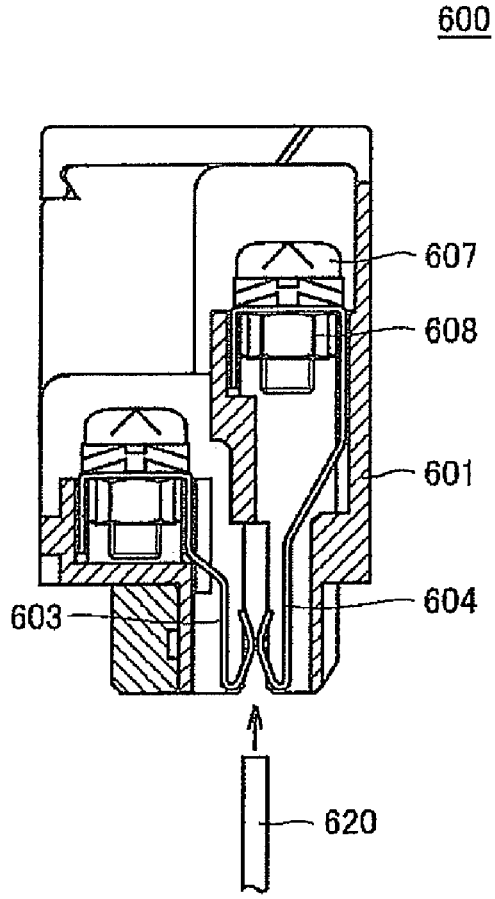
FIG. 18 is a view showing a configuration example of a terminal block of card edge type of the prior art.

The terminal block of card edge type of the prior art includes the connecting portion on the extended line extending from the insertion port of the substrate in the attachment/detachment direction of the substrate as shown in FIG. 17. Therefore, a substrate 230 for connection with a terminal block 110A needs to be attached to the circuit substrate 220 perpendicularly to the circuit substrate 220 as shown in FIG. 12 to direct the connecting portion of the terminal bock in the direction perpendicular to the main surface of the circuit substrate. However, the cost increases as the number of substrates increases.

Another realizing method includes a method of connecting the terminals of the terminal block and the electrodes of the circuit substrate by area contact. However, a structure for ensuring the reliability of the contact is required to realize such method, and thus the cost increases as well.

According to the present embodiment, on the other hand, each terminal 110 and 120 includes the supporting portion bent at substantially right angle from the connecting portion, and the contacting portion folded back so as to incline with respect to the supporting portion when the connecting portion is arranged on the upper side with the extending direction of the supporting portion as the up and down direction. The terminal block thus can be attached and detached in the direction parallel to the main surface of the circuit substrate without installing the base on the circuit substrate.

In the terminal block of card edge type of the prior art as well, the terminal block can be attached and detached in the direction parallel to the main surface of the circuit substrate. However, the terminal block and the circuit substrate entirely become long toward the terminal block side when the terminal block is connected to the circuit substrate. In one or more embodiments of the present invention, either the insertion depth (depth) of the terminal block is set long or a substrate for connection with the terminal block needs to be mounted on the circuit substrate as shown in FIG. 12.

In the former case, however, the area of the portion occupied by the terminal block of the surface of the circuit substrate becomes large. Furthermore, the portion occupied by the terminal block exists on both surfaces of the substrate. Thus, the mounting area of the surface of the circuit substrate narrows. According to the present embodiment, the main surface of the circuit substrate and the connecting portion of the terminal block can be directed in the same direction while suppressing the increase in the occupying area of the surface of the circuit substrate and the increase in the cost.

Figure 13:
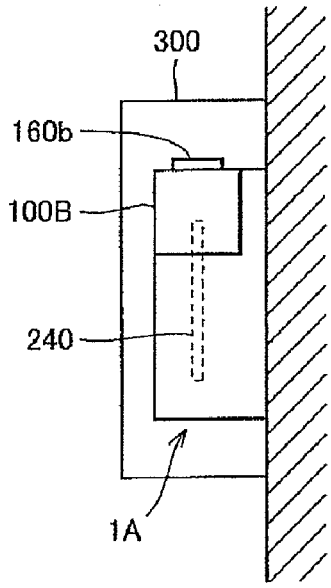
FIG. 13 is a schematic view describing a state in which an electronic device including the terminal block of the prior art is installed in a control board.

According to the present embodiment, the task of when connecting the electric wire to the connecting portion can be easily carried out. For instance, assume that an electronic device 1A including a terminal block 100B of card edge type of the prior art is installed in a control board 300 attached to the wall etc. of the building, as shown in FIG. 13. The electronic device 1A needs to be vertically arranged if the depth of the control board 300 is short. The circuit substrate 240 is thus also vertically arranged.

In the configuration of the terminal block of card edge type of the prior art, the connecting portion 160*b* is facing upward when the electronic device 1 is vertically arranged since the connecting portion of the terminal block is arranged in the inserting direction to the terminal block of the circuit substrate. If there is not enough space inside the control board, however, the task of connecting the electric wire to the connecting portion facing upward requires effort.

Figure 14:
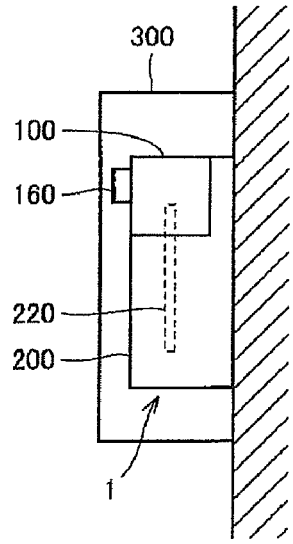
FIG. 14 is a schematic view describing a state in which an electronic device including the terminal block according to the first embodiment is installed in a control board.

According to the present embodiment, the connecting portion 160 is directed in the horizontal direction, that is, the outer side of the control board when the electronic device 1 is vertically arranged, as shown in FIG. 14. Therefore, the task for connecting the electric wire to the connecting portion of the terminal block can be facilitated.

The connecting portion is a screw type in the above-described configuration, but the configuration of the connecting portion is not limited to a screw type. The configuration of the connecting portion will be described below using the terminal 110 of the terminals 110 and 120 by way of example, but the configuration described below can also be applied to the terminal 120.

Figure 15:
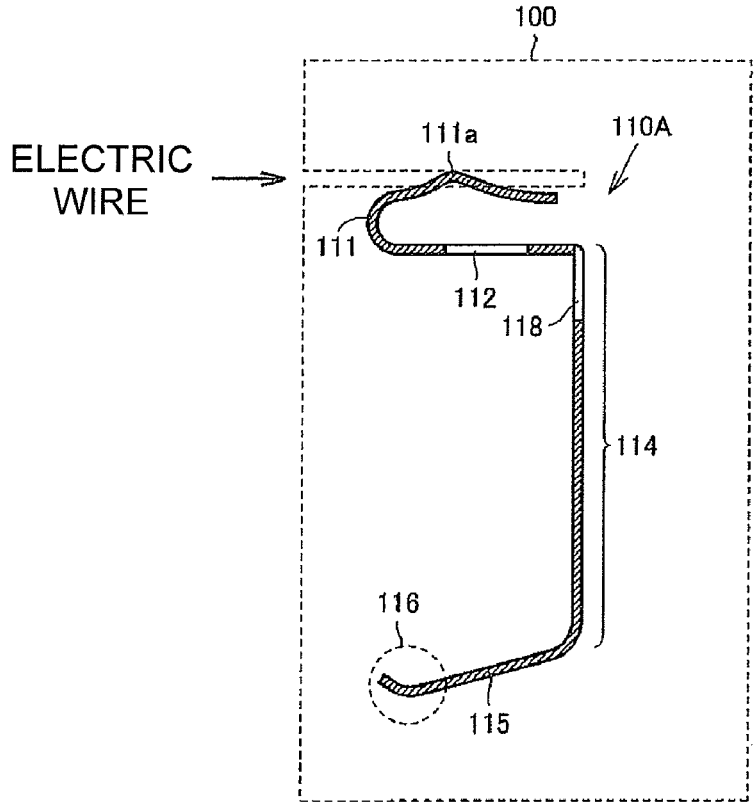
FIG. 15 is a schematic view showing the configuration of a terminal block including a connecting portion of a clamp type.

For instance, as shown in FIG. 15, the connecting portion may be a clamp type. A terminal 110A differs from the terminal 110 in that the connecting portion 111 is formed so as to be folded back approximately 180 degrees and a projection 111*a* is formed at the folded-back portion. When the electric wire is inserted o the terminal block 100, the folded-back portion of the connecting portion 111 is pushed down. The electric wire is pushed against the case while contacting the projection 111*a* of the connecting portion 111 by the elastic force of the relevant portion. The connecting portion 111 and the electric wire thus can be connected.

Figure 16:
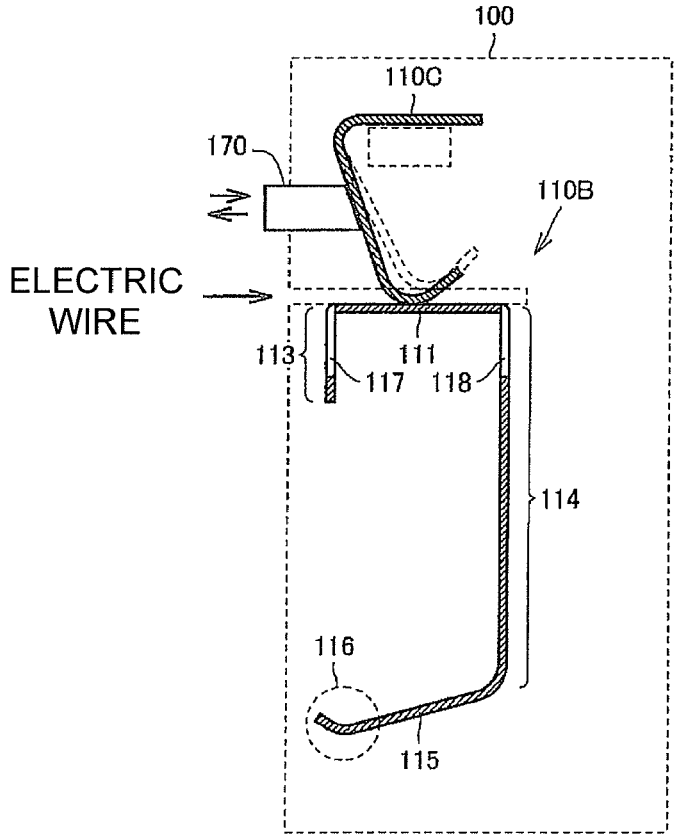
FIG. 16 is a schematic view showing the configuration of a terminal block including a connecting portion of an insulation displacement type.

As shown in FIG. 16, the connecting portion may be an insulation displacement type. According to the configuration shown in FIG. 16, the terminal block 100 includes an insulation displacement portion 110C that contacts the connecting portion 111 of the terminal 110B. The insulation displacement portion 110C is formed by an elastically deformable material (e.g., phosphor bronze thin plate). The distal end of the insulation displacement portion 110C lifts up and separates from the connecting portion 111 when a button 170 is pushed. If the electric wire is inserted to the terminal block in this state and the button 170 is released, the distal end of the insulation displacement portion 110C returns to the original position and the electric wire is pushed against the connecting portion 111. The connecting portion 111 and the electric wire thus can be connected.

The direction the contacting portion 115 of the terminal 110 and the contacting portion 125 of the terminal 120 respectively incline and the arrangement of such contacting portions are not limited to those described in the first embodiment. The terminals 110 and 120 may be arranged as shown in each embodiment described below.

The configuration of the entire terminal block according to each embodiment is similar to the configuration shown in FIGS. 1 and 2, and thus the description will not be repeated below. The terminal 110 and the terminal 120 of the terminal block according to each embodiment will be described in detail below.

[Second Embodiment]

Figure 19:
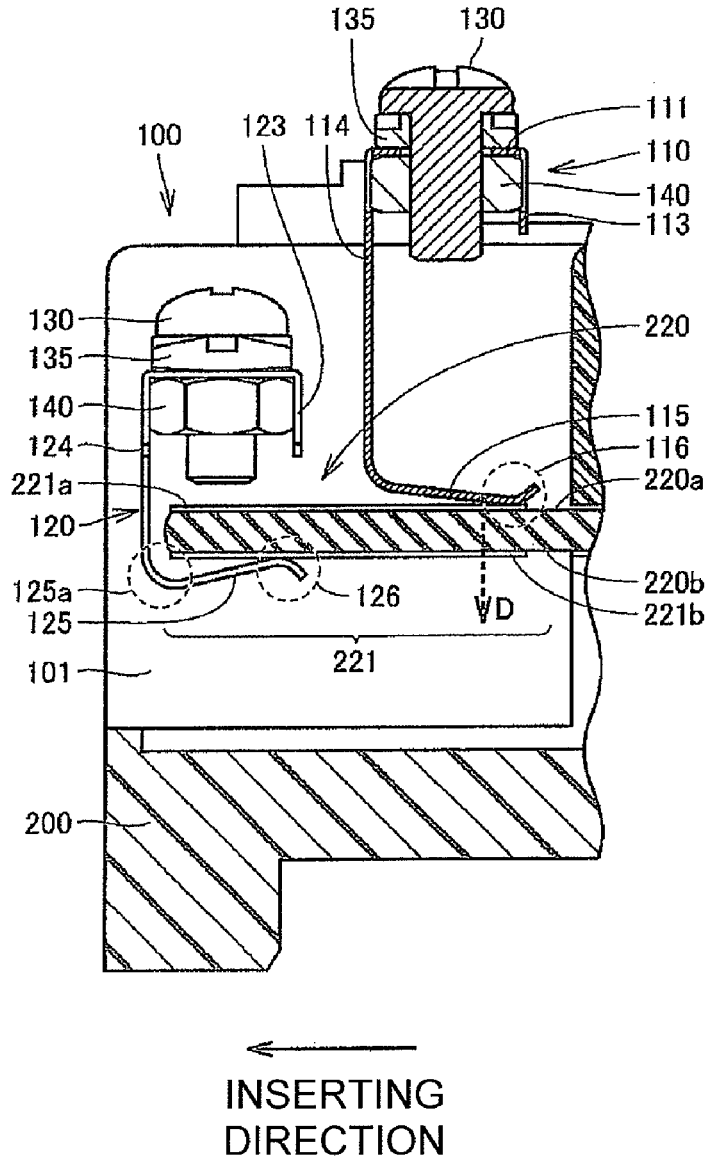
FIG. 19 is a view showing the terminals 110, 120 arranged inside a terminal block according to a second embodiment.

FIG. 19 is a view showing the terminals 110 and 120 arranged inside a terminal block according to a second embodiment. With reference to FIG. 19, the supporting portion 114 of the terminal 110 is arranged on a main surface 220*a* (first surface) side of the circuit substrate 220, and is extended in a normal direction (direction of arrow D) of the first surface (main surface 220*a*) and a second surface (main surface 220*b*) of the circuit substrate 220 inserted to the insertion port. The contacting portion 115 extends so as to incline in the direction opposite to the inserting direction of the circuit substrate 220 with respect to the normal direction of the main surfaces 220*a* and 220*b* of the circuit substrate 220 from the supporting portion 114. The contacting portion 115 is formed to contact the card edge terminal (electrode 221*a*) arranged on the main surface 220*a* of the circuit substrate 220. The configuration and the arrangement of the terminal 120 are the same as the configuration and the arrangement of the terminal 120 of the terminal block according to the first embodiment, and thus the description will not be repeated.

[Third Embodiment]

Figure 20:
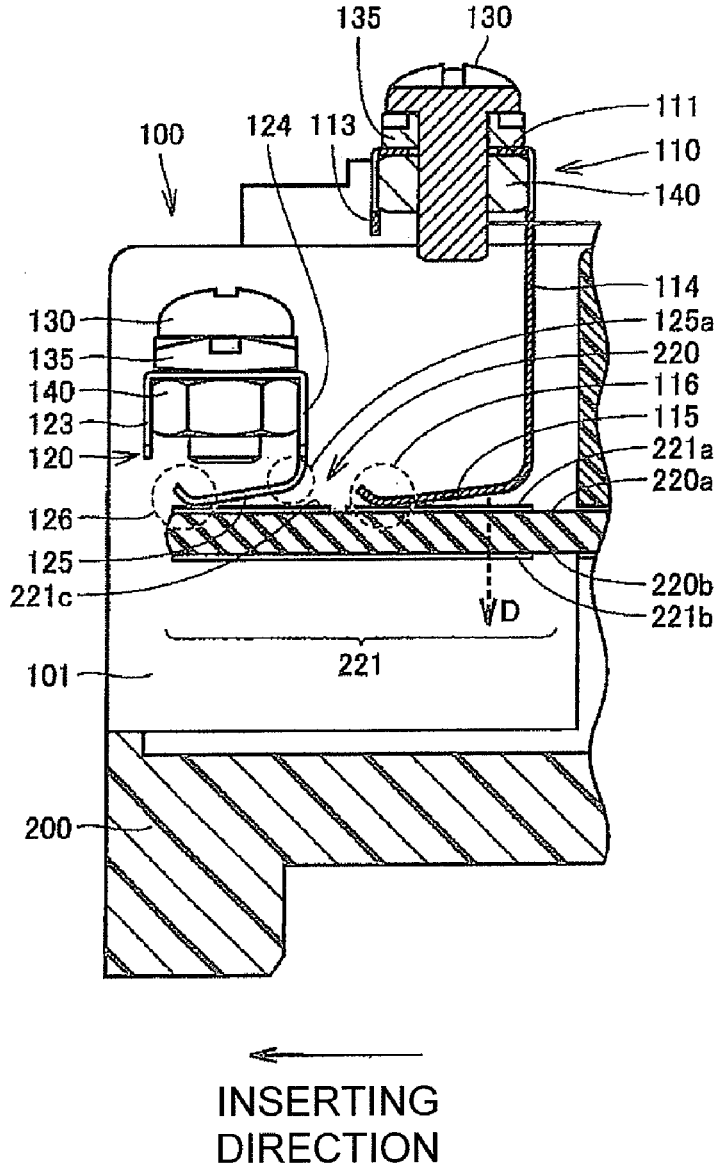
FIG. 20 is a view showing the terminals 110, 120 arranged inside a terminal block according to a third embodiment.

FIG. 20 is a view showing the terminals 110 and 120 arranged inside a terminal block according to a third embodiment. With reference to FIG. 20, the configuration and the arrangement of the terminal 110 are the same as the configuration and the arrangement of the terminal 110 of the terminal block according to the first embodiment, and thus the subsequent description will not be repeated.

The supporting portion 124 of the terminal 120 is arranged on the main surface 220*a* side of the circuit substrate 220, and is extended in a normal direction of the main surfaces 220*a* and 220*b* of the circuit substrate 220. The distal end of the supporting portion 124 (portion to be connected to the curved portion 125*a*) is positioned on the main surface 220*a* side of the circuit substrate 220.

The contacting portion 125 is inclined in the inserting direction of the circuit substrate 220 with respect to the normal direction. The contacting portion 125 contacts the card edge terminal (electrode 221*c*) arranged on the main surface 220*a* of the circuit substrate 220.

[Fourth Embodiment]

Figure 21:
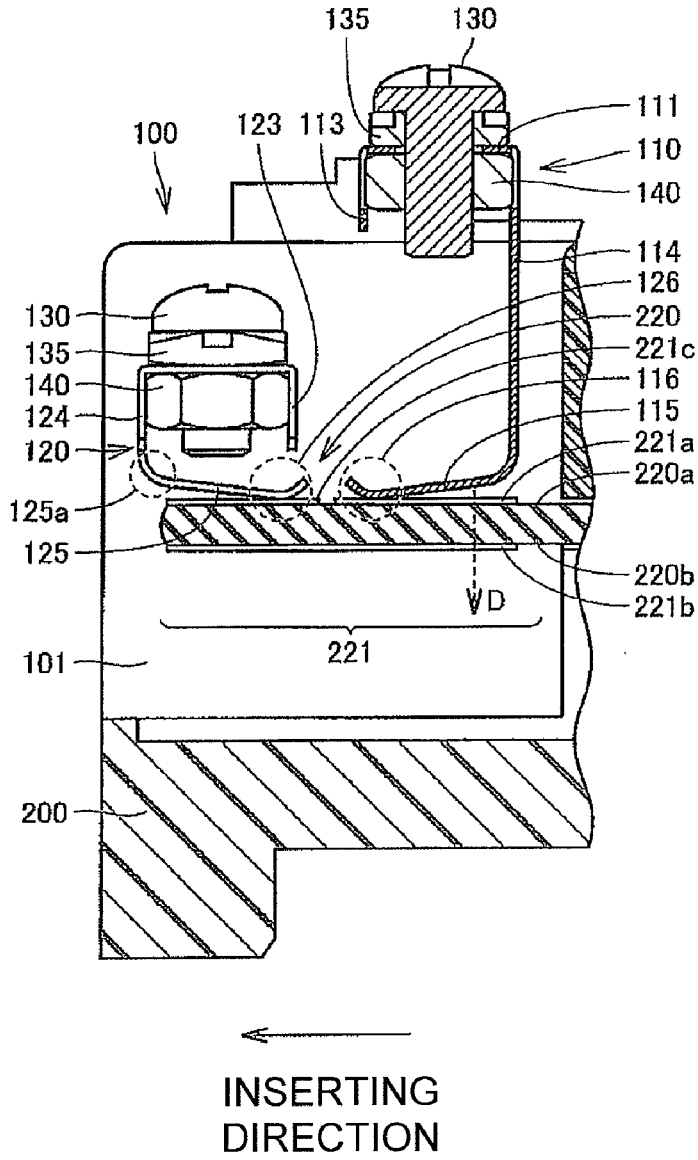
FIG. 21 is a view showing the terminals 110, 120 arranged inside a terminal block according to a fourth embodiment.

FIG. 21 is a view showing the terminals 110 and 120 arranged inside a terminal block according to a fourth embodiment. With reference to FIG. 21, the configuration and the arrangement of the terminal 110 are the same as the configuration and the arrangement of the terminal 110 of the terminal block according to the first embodiment, and thus the subsequent description will not be repeated.

The supporting portion 124 of the terminal 120 is arranged on the main surface 220*a* side of the circuit substrate 220, and is extended in a normal direction of the main surfaces 220*a* and 220*b* of the circuit substrate 220. The distal end of the supporting portion 124 (portion to be connected to the curved portion 125*a*) is positioned on the main surface 220*a* side of the circuit substrate 220.

The contacting portion 125 is inclined in the direction opposite to the inserting direction of the circuit substrate 220 with respect to the normal direction. The contacting portion 125 contacts the card edge terminal (electrode 221*c*) arranged on the main surface 220*a* of the circuit substrate 220.

[Fifth Embodiment]

Figure 22:
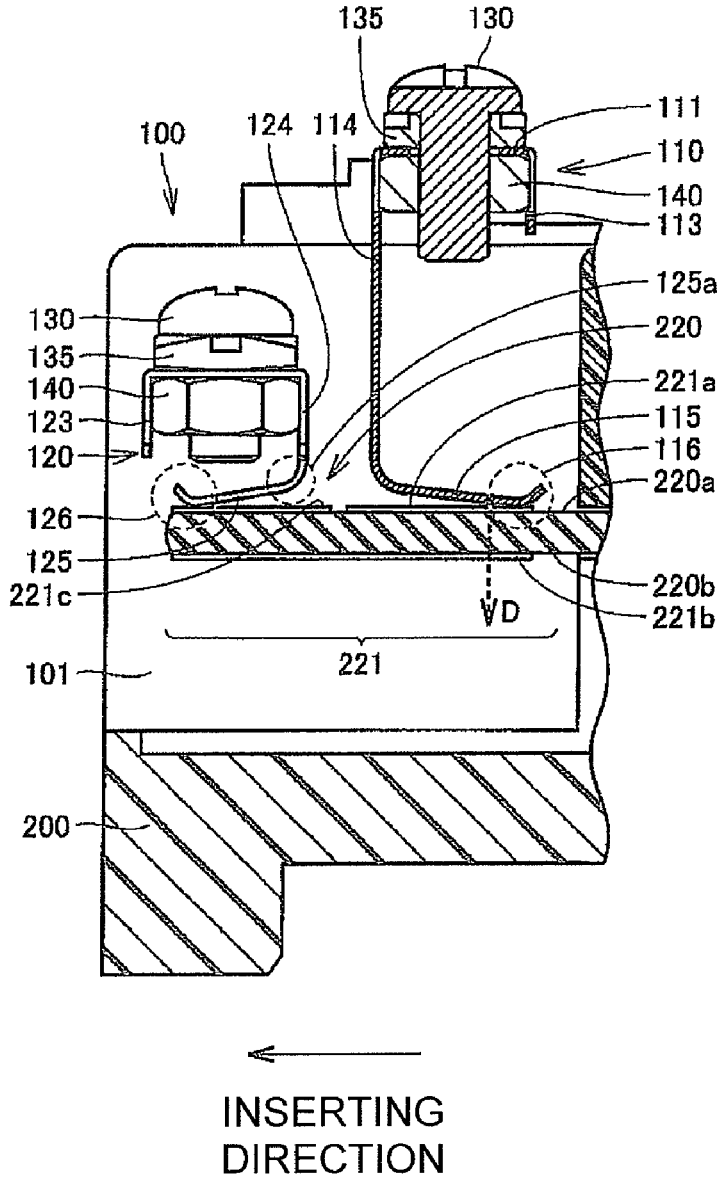
FIG. 22 is a view showing the terminals 110, 120 arranged inside a terminal block according to a fifth embodiment.

FIG. 22 is a view showing the terminals 110 and 120 arranged inside a terminal block according to a fifth embodiment. With reference to FIG. 22, the configuration and the arrangement of the terminal 110 are the same as the configuration and the arrangement of the terminal 120 (see FIG. 19) according to the second embodiment, and thus the subsequent description will not be repeated.

The configuration and the arrangement of the terminal 120 are similar to the configuration and arrangement of the terminal 120 (see FIG. 20) according to the third embodiment, and thus the subsequent description will not be repeated.

[Sixth Embodiment]

Figure 23:
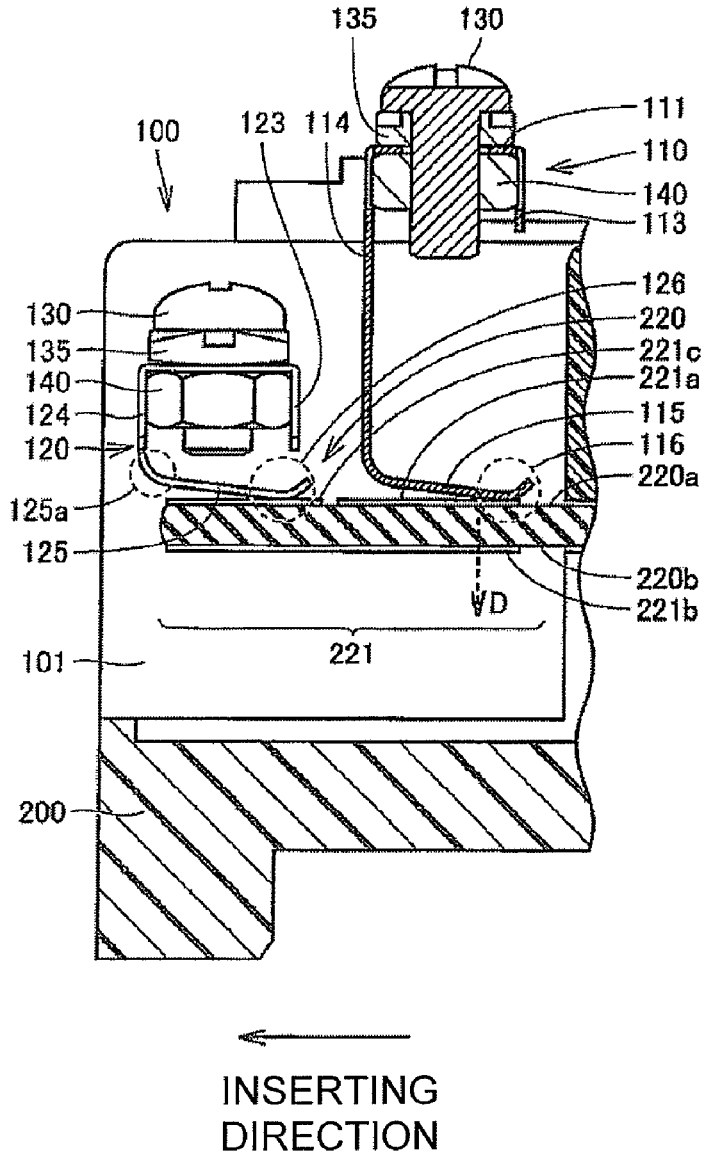
FIG. 23 is a view showing the terminals 110, 120 arranged inside a terminal block according to a sixth embodiment.

FIG. 23 is a view showing the terminals 110 and 120 arranged inside a terminal block according to a sixth embodiment. With reference to FIG. 23, the configuration and the arrangement of the terminal 110 are the same as the configuration and the arrangement of the terminal 110 (see FIGS. 19 and 22) according to the second and fifth embodiments, and thus the subsequent description will not be repeated. The configuration and the arrangement of the terminal 120 are similar to the configuration and arrangement of the terminal 120 (see FIG. 21) according to the fourth embodiment, and thus the subsequent description will not be repeated.

The embodiments disclosed herein are illustrative in all aspects and should not be construed as being exclusive. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims. The scope of the invention is defined by the claims and not by the description made above, and all meanings equivalent to the claims and all modifications within the scope are intended to be encompassed herein.

What is claimed is:

1. A terminal block configured to be connected to a plurality of first card edge terminals arranged at a peripheral edge part of a first main surface of a substrate and a plurality of second card edge terminals arranged at a peripheral edge of one of a second main surface of the substrate and the first main surface of the substrate, the terminal block comprising:

a base formed with an insertion port to which the peripheral edge of the substrate is inserted; and a plurality of first and second terminals arranged on the base; wherein each of the plurality of first terminals comprises:

a first supporting portion arranged on the first main surface side of the substrate and extended in a normal direction of the first and second main surfaces of the substrate inserted to the insertion port, and a first contacting portion formed from the first supporting portion to contact the first card edge terminals; and each of the plurality of second terminals comprises:

a second supporting portion arranged on one of first and second main surface sides of the substrate and extended in a normal direction of the first and second main surfaces of the substrate, and a second contacting portion formed from the second supporting portion to contact the second card edge terminals, wherein the first and second terminals are fixed on the base by screws, and wherein the screws fixing the first and second terminals are inserted into the base in the same direction that is perpendicular to that of contact pressure provided by the first and second contacting portions to the card edge terminals.

2. The terminal block according to claim 1, wherein the plurality of second terminals are arranged on a front side than the plurality of first terminals along an inserting direction of the substrate.

3. The terminal block according to claim 2, wherein a distal end of the second supporting portion is positioned on a second main surface side of the substrate; and the second contacting portion is formed to incline in a direction opposite to the inserting direction of the substrate with respect to the normal direction of the substrate from the distal end of the second supporting portion, and contact the second card edge terminals.

4. The terminal block according to claim 3, wherein the first contacting portion is extended to incline in the inserting direction of the substrate from the normal direction of the first and second main surfaces, and includes a first distal end that contacts the first card edge terminals when the first contacting portion is folded back diagonally to an upper side with respect to the first main surface of the substrate assuming the normal direction of the substrate is an up and down direction;

the second contacting portion includes a second distal end that contacts the second card edge terminals by being folded back from the second contacting portion diagonally to a lower side with respect to the second main surface of the substrate assuming the normal direction of the substrate is an up and down direction; and the first distal end and the second distal end are arranged so that positions in the inserting direction are different from each other.

5. The terminal block according to claim 3, wherein the first contacting portion is extended so as to incline in the direction opposite to the inserting direction of the substrate from the normal direction of the first and second main surfaces.

6. The terminal block according to claim 2, wherein a distal end of the second supporting portion is positioned on the first main surface side of the substrate; and the second contacting portion is formed to incline in the inserting direction of the substrate with respect to the normal direction of the substrate from the distal end of the second supporting portion, and contact the second card edge terminals.

7. The terminal block according to claim 2, wherein a distal end of the second supporting portion is positioned on the first main surface side of the substrate; and the second contacting portion is formed to incline in the direction opposite to the inserting direction of the substrate with respect to the normal direction of the substrate from the distal end of the second supporting portion, and contact the second card edge terminals.

8. The terminal block according to claim 6, wherein the first contacting portion is extended to incline in the inserting direction of the substrate from the normal direction of the first and second main surfaces.

9. The terminal block according to claim 6, wherein the first contacting portion is extended to incline in the direction opposite to the inserting direction of the substrate from the normal direction of the first and second main surfaces.

10. The terminal block according to claim 1, further comprising a plurality of screw-type connecting portions for electrically connecting each of the plurality of first terminals and the plurality of second terminals to a corresponding electric wire.

11. The terminal block according to claim 1, further comprising a plurality of clamp-type connecting portions for electrically connecting each of the plurality of first terminals and the plurality of second terminals to a corresponding electric wire.

12. The terminal block according to claim 1, further comprising a plurality of insulation displacement type connecting portions for electrically connecting each of the plurality of first terminals and the plurality of second terminals to a corresponding electric wire.

13. The terminal block according to claim 7, wherein the first contacting portion is extended to incline in the inserting direction of the substrate from the normal direction of the first and second main surfaces.

14. The terminal block according to claim 7, wherein the first contacting portion is extended to incline in the direction opposite to the inserting direction of the substrate from the normal direction of the first and second main surfaces.

15. The terminal block according to claim 1, wherein the first supporting portion extends longer than the second supporting portion.

16. The terminal block according to claim 2, wherein the first supporting portion extends longer than the second supporting portion.

17. The terminal block according to claim 3, wherein the first supporting portion extends longer than the second supporting portion.

* * * * *